US010953562B2

(12) United States Patent
Murphy et al.

(10) Patent No.: US 10,953,562 B2
(45) Date of Patent: Mar. 23, 2021

(54) PRINT FINISHING MACHINE

(71) Applicant: ROLLEM PATENT PRODUCTS LIMITED, Rotherham (GB)

(72) Inventors: Stuart Murphy, South Yorkshire (GB); Mark Hible, South Yorkshire (GB); Adam Huckle, South Yorkshire (GB)

(73) Assignee: ROLLEM PATENT PRODUCTS LIMITED, South Yorkshire (GB)

( * ) Notice: Subject to any disclaimer, the term of this patent is extended or adjusted under 35 U.S.C. 154(b) by 0 days.

(21) Appl. No.: 16/304,533

(22) PCT Filed: May 26, 2017

(86) PCT No.: PCT/GB2017/051527
§ 371 (c)(1),
(2) Date: Nov. 26, 2018

(87) PCT Pub. No.: WO2017/203297
PCT Pub. Date: Nov. 30, 2017

(65) Prior Publication Data

US 2019/0381684 A1 Dec. 19, 2019

(30) Foreign Application Priority Data

May 27, 2016 (GB) ..... 1609411

(51) Int. Cl.

| | |
|---|---|
| ***B26D 7/06*** | (2006.01) |
| ***B02C 18/00*** | (2006.01) |
| ***B26D 7/18*** | (2006.01) |
| *A63F 1/02* | (2006.01) |

(52) U.S. Cl.
CPC ..... *B26D 7/0675* (2013.01); *B02C 18/0007* (2013.01); *B26D 7/1863* (2013.01); *A63F 1/02* (2013.01); *A63F 2001/022* (2013.01); *B26F 2210/02* (2013.01)

(58) Field of Classification Search
CPC B26D 7/0675; B26D 7/1863; B02C 18/0007; A63F 1/02
USPC ..... 83/569
See application file for complete search history.

(56) References Cited

U.S. PATENT DOCUMENTS

| | | | | |
|---|---|---|---|---|
| 2,220,056 | A | 10/1940 | Donnerberg et al. | |
| 2,288,304 | A | 6/1942 | Schlattner | |
| 3,424,044 | A * | 1/1969 | Des Jardins | B26D 7/0675 83/255 |
| 3,546,990 | A | 12/1970 | Schneider | |
| 5,774,992 | A | 7/1998 | Lindenmuth | |
| 7,077,042 | B2 * | 7/2006 | Nogawa | B26D 7/025 83/466 |

(Continued)

FOREIGN PATENT DOCUMENTS

DE 102004027247 A1 9/2005

OTHER PUBLICATIONS

International Search Report and Written Opinion for Application No. PCT/GB2017/051527 dated May 26, 2017.

*Primary Examiner* — Omar Flores Sanchez
(74) *Attorney, Agent, or Firm* — Patterson & Sheridan, LLP

(57) ABSTRACT

A print finishing machine has a die and a drive mechanism. The drive mechanism is driven by a motor and the drive mechanism is configured to drive a stack of sheets of material through the die in order to cut the stack according to the shape of the die.

14 Claims, 3 Drawing Sheets

(56) References Cited

U.S. PATENT DOCUMENTS

| | | | | |
|---|---|---|---|---|
| 2003/0079584 | A1* | 5/2003 | Cote | B26D 1/09 83/13 |
| 2003/0084770 | A1 | 5/2003 | Gross et al. | |
| 2006/0011039 | A1* | 1/2006 | Kanemitsu | B30B 1/18 83/684 |
| 2008/0041243 | A1* | 2/2008 | Sakamoto | B30B 1/42 100/39 |
| 2014/0125921 | A1* | 5/2014 | Takemura | B26D 7/27 349/65 |

* cited by examiner

PRINT FINISHING MACHINE

FIELD OF THE INVENTION

The present invention relates to a print finishing machine. In particular, a print finishing machine having a die cutter.

BACKGROUND OF THE INVENTION

When printing, for example, playing cards, it is most time and resource efficient for multiple playing cards, arranged in a grid, to be printed onto a single sheet of card. After printing, the single sheet of card may be passed through a slitting machine which cuts out the individual playing cards.

It is important that each and every playing card is the same size in order to form a high quality uniform deck to make the deck easy to handle and shuffle. Slitting machines typically do not offer sufficient precision to cut each and every playing card to exactly the same size such that the deck would have a high quality and uniform finish. Additionally, slitting machines are only capable of cutting straight edges, and it is desirable to round the corners of the playing cards.

So, it is common to arrange the slitting machine to leave a border around the edge of the printed playing cards. The individual playing cards are collated together to form a deck and a die cutter is used to cut the whole deck, resulting in a more uniform finish to the deck and rounded corners.

However, there are problems with existing die cutters. Most die cutters require the playing cards to be hand-loaded, meaning that the collated decks must be retrieved from the slitting machine by an operator and loaded by hand into the die cutter. Once cut, the cut decks then need to be removed from the die cutter by hand and passed on for further operations, such as wrapping and packing.

These hand-loaded die cutters tend to be driven by hydraulic or pneumatic systems which are complicated to build and maintain, and which do not offer a high degree of positional accuracy. A lack of positional accuracy can lead to poor quality decks being produced, increasing wastage, and can lead to an increase in the time required to process each deck, adding to the manufacturing costs.

The only die cutters that do not require hand-loading and are designed to work in-line as a component in a continuous print finishing process tend to be complicated to adjust, have a tendency to be unreliable, and are prone to twisting and movement during operation which can lead to poor quality decks.

It would therefore be desirable to find a die-cutter which overcome these disadvantages, and which does not require hand-loading.

SUMMARY OF THE INVENTION

According to a first aspect of the invention, there is provided a print finishing machine. The print finishing machines comprises a die and a drive mechanism. The drive mechanism is driven by a motor. The drive mechanism is configured to drive a stack through the die in order to cut the stack according to the shape of the die. The stack comprises sheets of material.

The fact that the drive mechanism is driven by a motor, such as a servomotor or stepper motor, makes the construction and operation of the print finishing machine simpler than a print finishing machine which uses a hydraulic or pneumatic drive mechanism, or a print finishing machine which uses a mechanical drive mechanisms, such as a flywheel and crankshaft. The motor driven drive mechanism is also able to operate at a higher repetition rate than pneumatic or hydraulic drive mechanisms (which tend to overheat if run at a high repetition rate) which means that the motor driven drive mechanism can be arranged in-line as a component in a print-finishing process, removing the need for hand-loading and unloading of the stack.

A mechanical drive mechanism based on a flywheel and crankshaft has a drive axis which tends to oscillate about a cutting axis of the die as the flywheel rotates. This oscillation introduces unwanted twisting and movement of the die which, in turn, can lead to poor quality cutting of the stack (for example, introducing a twist into the stack). In contrast, the motor driven drive mechanism operates along a drive axis which is aligned, or substantially aligned, with a cutting axis of the die, so the motor driven drive mechanism is less likely to introduce unwanted twisting and movement of the die.

The print finishing machine may be arranged in-line as a component in a print finishing process. That is, the print finishing machine may receive the stack from a previous print finishing machine (such as a slitting machine) and/or the print finishing machine may be configured to pass the stack to a further print finishing machine (such as a wrapping or packing machine).

The print finishing machine may further comprise a pusher configured to collect the stack from an input and transport the stack to the surface. For example, the pusher may be configured to collect the stack from an output of a previous print finishing machine (such as a slitting machine), or collect the stack from a conveyor.

The pusher may align the stack with the die. For example, the print finishing machine may comprise a barrier. The pusher may urge the stack against the barrier in order to align the stack with the die.

The print finishing machine may comprise a channel between an input and an output of the print finishing machine. The pusher may convey the stack along the channel. The barrier may block the channel and the pusher may urge the stack against the barrier. The channel and barrier may constrain the stack and may help to align the stack with the die.

After cutting, the pusher may be configured to pass the cut stack to a further print finishing machine (such as a wrapping or packing machine), or pass the cut stack to a conveyor. The barrier may be configured to open after cutting, and the pusher may pass the stack through the barrier.

The barrier may be pneumatically actuated.

The pusher may comprise a lead screw driven by a motor, such as a servomotor, which moves the pusher, allowing accurate control of the position of the stack with respect to the die.

The motor may be a servomotor. The encoders and feedback mechanism of a servomotor provide a high degree of positional accuracy and repeatability which is advantageous in order to increase the speed of operation, improve cutting quality and consistency, reduce damage to machine components and make the print finishing machine easier for an operator to setup than print finishing machines using pneumatic, hydraulic or mechanical drive mechanisms.

The print finishing machine may comprise an anvil. The anvil may be driven by the drive mechanism. The anvil may be configured to drive the stack through the die. The direction of movement of the anvil may be constrained by guides. The anvil may be constrained to move along an axis by the guides. For example, the anvil may be constrained by the guides to move along an axis that is aligned, or substantially aligned, with the cutting axis of the die, in order to reduce twisting or movement of the stack which could lead to poor quality cutting. The print finishing machine may comprise legs which may support components of the print finishing machine, such as, the drive mechanism, the channel and/or a surface, and which help to ensure that key components of the print finishing machine are aligned. The guides may be arranged to slide along the legs.

The print finishing machine may comprise a surface. The surface may be configured to receive the stack. The surface may be moveable inside the die, for example, along a cutting axis of the die. The surface may be mounted inside the die. The surface may be mounted to a resilient member, such as a spring.

Before cutting, the stack may be placed on the surface and supported by the surface. During cutting, the drive mechanism may urge the stack, and hence the surface, towards the die and the resilient member may be compressed under the force applied by the drive mechanism. The stack may be pushed through the die causing the stack to be cut. Once the whole stack has been cut, the drive mechanism may be retracted and the resilient member may urge the surface, and hence the stack, upwards back to the position before cutting. This counter pressure arrangement provided by the surface and resilient member on one side of the stack and the anvil on the other side of the stack reduces the likelihood of deforming or bending the stack during cutting.

The drive mechanism may comprise a linear actuator driven by the motor. The linear actuator may be configured to drive the stack of sheets. The linear actuator may comprise a lead screw or a pneumatic actuator. The motor and the actuator may be coupled by a gearing mechanism arranged to increase the torque of the drive mechanism. The motor and actuator may be arranged in a side-by-side configuration. A side-by-side configuration reduces the height as opposed to the motor being arranged behind and directly driving the actuator, as well as allowing for the possibility of linking the motor and actuator by a gearing mechanism to increase torque.

The drive mechanism may comprise a pair of magnetic limit switches configured to limit the motion of the drive mechanism. Such magnetic limit switches act as a safety mechanism which prevents the drive mechanism traveling outside a pre-determined range, which reduces the likelihood of damage to the drive mechanism or other parts of the print finishing machine.

The print finishing machine may further comprise a cutting tool arranged to shred waste material (such as off-cuts) from the stack. Shredding the waste material reduces the likelihood that the waste material will foul the print finishing machine. The cutting tool may comprise a plurality of cutting tools, such as a plurality of blades, arranged around the outside of the die.

The print finishing machine may comprise an extractor configured to remove waste material from the print finishing machine, to prevent a build-up of waste material from fouling the print finishing machine. The extractor may comprise a shroud around the die. The extractor may comprise a vacuum cleaner coupled to the shroud which removes the waste material, for example, to a refuse container.

The sheets of material may comprise paper, card or plastic. The sheets of material may be playing cards, game cards, trading cards, business cards or labels. The stack may be one or more decks of cards.

According to a second aspect of the invention, there is provided a method of manufacturing a print finishing machine according to the first aspect.

According to a third aspect of the invention, there is provided a method of using a print finishing machine according to the first aspect.

BRIEF DESCRIPTION OF THE DRAWINGS

The invention shall now be described, by way of example only, with reference to the accompanying drawings in which.

DETAILED DESCRIPTION

Figure 1:
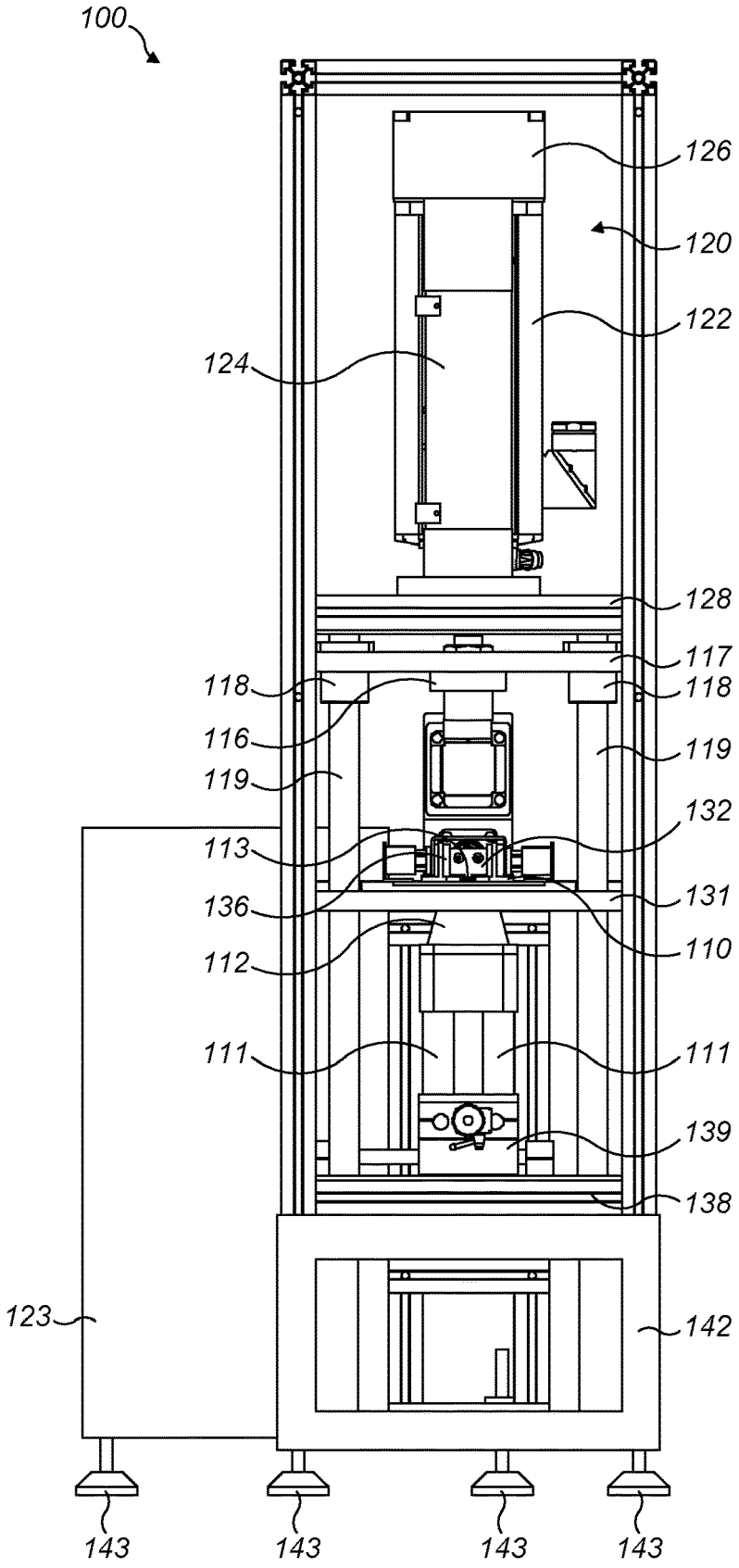
FIG. 1 illustrates an end view of a print finishing machine according to an embodiment of the present invention.
Figure 2:
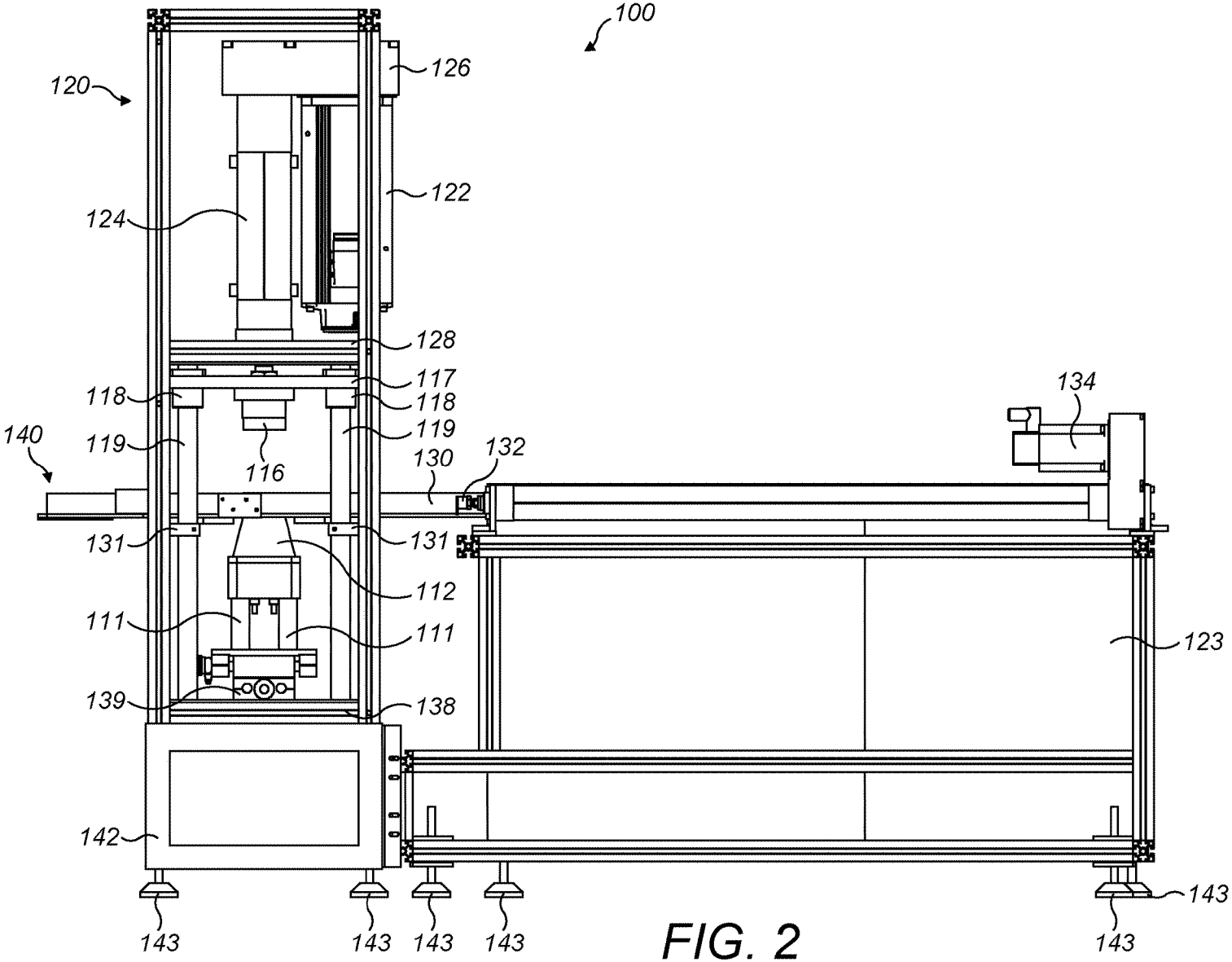
FIG. 2 illustrates a side view of the print finishing machine of FIG. 1.
Figure 3:
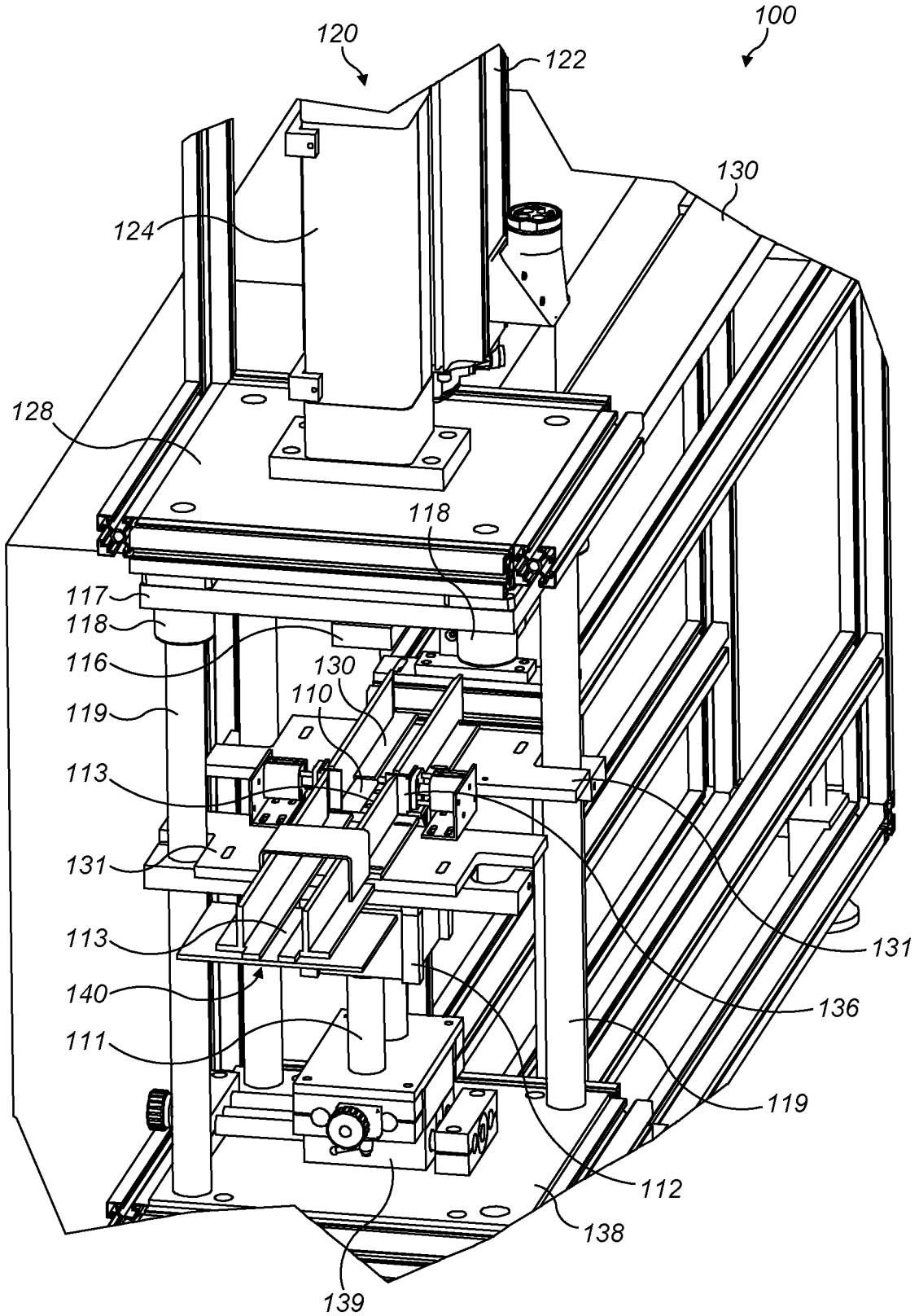
FIG. 3 illustrates a close-up view of a portion of the print finishing machine of FIGS. 1 and 2.

FIGS. 1 and 2 show respective end and side views of a print finishing machine 100. FIG. 3 shows a close-up view of a portion of the print finishing machine 100.

The print finishing machine 100 has a die 112. By driving a stack of sheets of material, in this example a deck of playing cards, through the die 112 the deck of playing cards can be cut according to the shape of the die 112 in order to produce a deck of playing cards with a high quality and uniform finish and rounded corners.

Drive mechanism 120 includes a lead screw 124 driven by servomotor 122. The servomotor 122 and lead screw 124 are in a side-by-side configuration with the servomotor 122 coupled to lead screw 124 by planetary gears 126. The planetary gears 126 reduce the speed of servomotor 122 and increase the torque applied to lead screw 124. The drive mechanism 120 drives an anvil 116 against the deck of playing cards, forcing the deck through the die 112. The servomotor 122 is attached to servomotor controller 123 which powers and controls the servomotor 122.

The deck of playing cards is supported from underneath by surface 110. Surface 110 is mounted to springs fixed to the base of die 112 and is moveable within the die 112. Before cutting, the deck of playing cards is supported by the surface 110 from below. During cutting, the anvil 116 urges the deck towards the die 112, compressing the springs. The deck is forced through the die 112 causing the deck to be cut. Once the deck has been cut, the anvil 116 is retracted and the springs urge the surface 110, and hence the deck, upwards back to the position the surface 110 was in prior to cutting. By supporting the deck from below, the surface 110 reduces the likelihood of deforming or bending the deck as the deck is forced through the die 112. Also, the retractable surface 110 means that the deck does not get stuck inside the die 112 after cutting, making it possible to remove the deck after cutting by simply sliding the deck off the surface 110 with a pusher 132.

The drive mechanism 120 has an encoder which allow the position of the anvil 116 to be determined accurately, and a feedback mechanism to precisely control the range of travel of the anvil 116 to ensure that the whole deck is cut, to ensure that the anvil 116 is moved out of the way after cutting so that the deck can be removed with pusher 132 so a new deck can be inserted, and to ensure that the anvil 116 is not driven beyond the range of travel needed to cut the deck (which could lead to damage, and which could reduce the number of decks of cards that could be processed in a given time).

The drive mechanism 120 is mounted on plate 128 which is supported by legs 119. The anvil 116 is attached to a plate 117, and each corner of the plate 117 has a guide 118 which slides along legs 119 to constrain the anvil 116 to move along a cutting axis of the die in order to reduce unwanted twisting or movement of the deck during cutting which could otherwise lead to poor quality cutting.

A channel 130 is attached towards the middle of legs 119 by brackets 131. Base 138 is attached at the bottom of legs 119. Posts 111 support the die 112. The posts 111 are attached to translation stage 139 fixed to base 138. The translation stage 139 allows the position of the die 112 to be controlled to align the die 112 with channel 130 and deck to ensure an accurate cut.

The base 138 is sat on frame 142 which has feet 143 which establish a suitable height of the print finishing machine 100, for example, to allow the print finishing machine 100 to interface with any other elements in the print finishing process (such as a slitting machine, or a wrapping machine)

The decks of playing cards that are loaded into the print finishing machine 100 have been cut into individual cards on a slitting machine and collated into a deck. The decks of playing cards are loaded into channel 130 from a conveyor belt (not shown) which couples the channel 130 to the slitting machine.

A pusher 132 is attached to a lead screw driven by a servomotor 134 which controls the position of the pusher 132 along a channel 130. The pusher 132 transports the stack along the channel 130 to surface 110. The channel 130 and the surface 110 have a groove 113 into which an end of the pusher 132 is received. The groove 113 ensures that the pusher 132 transports the whole stack along the channel 130 and onto the surface 110, making sure the bottom cards do not get left behind or stuck.

The pusher 132 urges the stack up against barrier 136 which, before cutting, is closed and blocking the channel 130. The channel 130 and barrier 136 constrain the position of the stack in order to help align the stack with the surface 110 and die 112.

The barrier 136 is pneumatically actuated, so after cutting the barrier 136 can be opened allowing the pusher 132 to pass the cut stack to the output 140. The output 140 may be connected to a conveyor which could take the cut stack on to a further print finishing machine (such as a wrapping or packing machine).

The die 112 may have a plurality of blades arranged around the outside edge of the die 112. As the deck is cut, the off-cut material is shredded into small pieces by the blades to reduce the likelihood that the off-cut material will foul the print finishing machine 100. A shroud may be placed around the die 112 which is coupled to a vacuum cleaner which removes the off-cut material to a refuse container.

Although the invention has been described in terms of a particular embodiment, the skilled person will appreciate that various modifications could be made without departing from the scope of the appended claims.

For example, the invention has been described in terms of cutting a deck of playing cards. The invention could cut simultaneously multiple decks stacked on top of one another. The invention could also be applied to cutting game cards, trading cards, business cards, labels or the like. Equally, the invention could be applied to cutting a stack comprising any kind of sheets of material such as paper, card or plastic.

The die 112 may have any desired shape corresponding with the desired cut shape of the stack.

The invention claimed is:

1. A print finishing machine comprising:

a die; and a drive mechanism driven by a motor, wherein the drive mechanism is configured to drive a stack through the die in order to cut the stack according to the shape of the die, wherein the stack comprises sheets of material, and wherein the motor is a servomotor;

a pusher configured to collect the stack and align the stack with the die; and a barrier, wherein the pusher is configured to urge the stack against the barrier, and wherein the barrier is arranged to align the stack with the die, wherein the barrier is configured to open after cutting, and the pusher is configured to pass the stack through the barrier.

2. The print finishing machine of claim 1, wherein the drive mechanism has a drive axis substantially aligned with a cutting axis of the die.

3. A print finishing machine comprising:

a die; and a drive mechanism driven by a motor, wherein the drive mechanism is configured to drive a stack through the die in order to cut the stack according to the shape of the die, wherein the stack comprises sheets of material, and wherein the motor is a servomotor; and an anvil, wherein the anvil is driven by the drive mechanism and wherein the anvil is configured to drive the stack through the die.

4. The print finishing machine of claim 3, wherein the direction of movement of the anvil is constrained by guides.

5. The print finishing machine of claim 4, further comprising legs, wherein the guides slide along the legs.

6. The print finishing machine of claim 5, wherein the legs support the drive mechanism and/or a surface.

7. A print finishing machine comprising:

a die; and a drive mechanism driven by a motor, wherein the drive mechanism is configured to drive a stack through the die in order to cut the stack according to the shape of the die, wherein the stack comprises sheets of material, and wherein the motor is a servomotor; and a surface configured to receive the stack, wherein the surface is moveable inside the die.

8. The print finishing machine of claim 7, wherein the surface is mounted to a resilient member.

9. The print finishing machine of claim 3, wherein the drive mechanism further comprises a linear actuator driven by the motor, wherein the linear actuator is configured to drive the stack, and wherein the motor and the linear actuator are coupled by a gearing mechanism arranged to increase the torque of the drive mechanism.

10. The print finishing machine of claim 9, wherein the motor and linear actuator are arranged in a side-by-side configuration.

11. The print finishing machine of claim 7, wherein the drive mechanism further comprises a pair of magnetic limit switches configured to limit the motion of the drive mechanism.

12. The print finishing machine of claim 3, further comprising a cutting tool arranged to shred waste material from the cut stack, wherein the cutting tool comprises a plurality of cutting tools arranged around the outside of the die.

13. The print finishing machine of claim 7, further comprising an extractor configured to remove waste material from the print finishing machine, wherein the extractor comprises a shroud around the die.

14. The print finishing machine of claim 13, wherein the extractor comprises a vacuum cleaner coupled to the shroud.

* * * * *